US006164479A

United States Patent [19]

Kern

[11] Patent Number: 6,164,479

[45] Date of Patent: Dec. 26, 2000

[54] INTERNAL FLOATING ROOF TANK AND PERIPHERAL SEAL

[75] Inventor: Ronald Carl Kern, Katy, Tex.

[73] Assignee: Ultra Flota Corp., Houston, Tex.

[21] Appl. No.: 09/212,188

[22] Filed: Dec. 15, 1998

Related U.S. Application Data

[63] Continuation of application No. 08/709,106, Sep. 6, 1996, abandoned.

[51] Int. Cl.[7] ..... B65D 88/46

[52] U.S. Cl. ..... 220/216; 220/219; 220/222; 220/224; 220/287

[58] Field of Search ..... 220/287, 216, 220/221, 219, 222, 224

[56] References Cited

U.S. PATENT DOCUMENTS

| | | | |
|---|---|---|---|
| 2,568,518 | 9/1951 | Smith | 220/640 |
| 2,600,237 | 6/1952 | Graham | 220/224 |
| 2,802,591 | 8/1957 | Wiggins . | |
| 2,840,260 | 6/1958 | Wiggins | 220/224 |
| 2,888,161 | 5/1959 | Springer | 220/224 |
| 4,371,909 | 2/1983 | Ogarek et al. | 220/224 |
| 5,036,995 | 8/1991 | Wagoner | 220/224 |
| 5,103,992 | 4/1992 | Lippiello et al. | 220/224 |
| 5,145,097 | 9/1992 | Lowe | 220/325 |
| 5,284,269 | 2/1994 | Petrie et al. | 220/224 |
| 5,372,270 | 12/1994 | Rosenkrantz | 220/224 |
| 5,494,450 | 2/1996 | Kirsch et al. | 439/188 |
| 5,529,200 | 6/1996 | Ford et al. | 220/224 |
| 5,667,091 | 9/1997 | Slaber, Jr. et al. | 220/224 |

*Primary Examiner*—Stephen P. Garbe
*Attorney, Agent, or Firm*—Howrey Simon Arnold & White, LLP

[57] ABSTRACT

A floating roof storage tank which includes a peripheral sealing ring of shoes distributed around the periphery of an internal floating roof within a storage tank. Spring loaded or otherwise resilient members with essentially level horizontal travel (without vertical travel) attached to the deck of the internal floating roof keep the peripheral sealing ring of shoes pressed against the tank wall and also keep the internal floating roof centered within the tank. The space between the peripheral sealing ring of shoes and the internal floating roof is covered by a flexible material that prevents product loss. Jamming of the resilient members between the tank shell and the relatively flexible rim of the internal floating roof is reduced or eliminated due to the level horizontal travel of the hanger-pushers and their horizontal mounting to the top of the deck. Vertical movement of the individual shoe segments over each other is also reduced or eliminated due to the level horizontal travel of the resilient members. The seal at the overlap of the shoe segments is assured by a stiffened leading edge along with the close proximity of resilient members.

37 Claims, 12 Drawing Sheets

INTERNAL FLOATING ROOF TANK AND PERIPHERAL SEAL

This is a continuation of application Ser. No. 08/709,106 filed Sep. 6, 1996, now abandoned.

BACKGROUND OF THE INVENTION

1. Field of the Invention

The present invention relates to storage tanks with floating roofs, and more particularly to an improved apparatus for sealing the rim space between an inner wall of a storage tank and the periphery of an internal floating roof within the storage tank.

2. Description of the Prior Art

Bulk fluids such as petroleum and fuel products are usually stored in large cylindrical tanks. These are commonly equipped with internal floating roofs to minimize product losses to the atmosphere. A critical part of the internal floating roof is the sealing mechanism that is installed in the interstitial space between the internal floating roof and the inner wall of the storage tank. Because the internal floating roof has a circumferential edge or "rim", this annular space is commonly called the "rim space." This sealing mechanism is designed to allow the floating roof to stay afloat on the stored product, to maintain a vapor seal, to move easily within the tank as the product levels rise and fall, and to keep the internal floating roof centered within the tank.

The sealing ring, or mechanical shoe type seal, has proven over the years to be one of the more effective types of sealing device. The mechanical shoe type seal consists of a sealing ring that completely encircles the inner periphery of the storage tank wall. This sealing ring is formed of multiple segments or "shoes" that overlap or are connected by some form of expansion joint. This configuration allows for expansion and contraction of the sealing ring segment joints as the tank diameter (and therefore the circumference) varies due to fabrication tolerances and foundation settlement.

The sealing ring is generally supported by hanger-bars or linkages, and various designs have been created and implemented for this purpose. The hanger-bars or linkages are mounted at one end to the side of the internal floating roof's rim which faces outward (toward the wall of the tank), extend on an incline toward the tank wall, and are connected at a second end to the shoe segments. Because the sealing ring supports are mounted at some angle, the vertical forces (frictional and gravitational) acting on the shoe segments transfer the force in part as horizontal loadings, into the lower edges of the rim plate.

The most common form of support is the inclined hanger-bar attached near the upper third of the metal shoe and at or below the lower edge of the internal floating roofs rim plate. Experience has shown that the maximum practical angle between the inclined hanger-bar and the vertical tank shell is on the order of 30°. If the angle is allowed to become greater than this (get closer to the horizontal) the horizontal force vector against the shoe increases the vertical frictional force and the shoe "jams" against the shell. Once this point is reached it becomes "self-energizing" in that additional vertical force adds to the horizontal force vector and the vertical frictional force increases even more.

To keep inclined hanger-bar supports less than this 30° angle, a lengthy inclined hanger-bar is generally employed. The lower pivot point must be on the order of 20 inches or more below the upper pivot point for typical rim spaces or run the risk of the system jamming. One problem associated with this structure is that the lower pivots, and a substantial portion of the hanger-bars, are located below the liquid level and are not easily accessible for maintenance or repair. In addition, considerably more material is required to construct the hanger-bars in this manner.

Internal floating roofs, particularly lightweight internal floating roofs which are generally made of aluminum, are, by design, fairly flexible devices. Flexure of the lower edge of an internal floating roof moves the lower pivot of the hanger-bars horizontally, effectively increasing the angle between the inclined hanger-bar and the vertical tank shell. Additional braces and stiffeners must be employed to resist this flexure.

Internal floating roofs are also designed to be as shallow as possible, to maximize the capacity of the storage tank. Maximum and minimum liquid levels are dictated by interference between the internal floating roof and a fixed roof structure or the tank's interior bottom piping. In addition to increasing material and construction costs, these braces and stiffeners needed to resist flexure in the lower edge of the floating roof structure may also increase the minimum liquid level by reducing the level to which the internal floating roof may drop. As a result, the effective useable storage capacity of the storage tank is reduced.

Another problem associated with this structure is the elevation of individual elements of the sealing ring also changes, because the travel of the upper end of these inclined hanger-bars describes an arc as the rim space changes. The rim space may increase or decrease due to settlement of the tank foundation, original tolerances, or other factors. With the inclined hanger-bar apparatus, variances in the rim space create alignment and fit-up problems that require additional details and equipment to overcome.

Other forms of support have been used over the years including various forms of "pantograph" or "scissors" linkages with horizontal pivot pins. These all require support from the lower edge of the internal floating roofs rim plate and are all subject to the same "jamming" limitations and other problems associated with the inclined hanger-bar system. If these linkage systems are too shallow, or if the support from the bottom edge of the rim plate moves inward due to flexure of any form, the same "self-energizing" jamming mechanism can occur.

As discussed above, the shoe segments overlap or are connected by expansion joints. The most common methods of constructing expansion joints are: (1) the use of flexible fabric at the end of every shoe segment, where the flexible fabric is riveted or bolted to the shoe's vertical edge, (2) the use of a metal expansion joint formed into each shoe segment, and (3) the use of an overlap at the ends of the shoe segments. In the situation where an overlap is used, various means may be employed to keep the overlap a snug fit.

The fabric expansion joints often present a compatibility and service life problem. The metal expansion joints incorporate U-shapes formed into the shoes that allow gaps or openings that exceed accepted gap criteria and promote product loss and environmental pollution. The overlapped ends is the simplest means of creating a seal between adjacent shoe segments, but the various means used to insure a snug fit often complicate this joint, and may not ensure that product loss is minimized.

SUMMARY OF THE INVENTION

The current invention concerns apparatus for sealing the rim space between an internal floating roof movably disposed within a bulk fluid storage tank and the internal surface of the tank wall. In a broad aspect the apparatus comprises a plurality of shoes distributed around the upper end of an internal floating roof and urged resiliently and laterally from the upper end of the floating roof into contact with the inner wall surface of the tank. A flexible vapor barrier positioned between the shoes and the floating roof acts to seal the rim space between the floating roof and the inner wall surface of the tank. The vapor barrier also helps to seal off the shoes and the upper end of the floating roof from the contents of the tank.

In one embodiment, suitable resilient members are mounted on the top surface of the internal floating roof for supporting the shoes and urging them against the tank wall surface. The degree of urging is controlled to help centralize the floating roof with the tank and also enable the shoes to travel vertically up and down the tank wall surface with the floating roof Other embodiments include the resilient members mounted to the upper portion of the internal floating roof's sidewall, or mounted to the bottom surface of the top of the internal floating roof, where the sidewall construction permits attachment in this manner. It is desirable for the resilient members to be connected to the upper portion of the internal roof's structure, as the framing members of an internal floating roof are typically located at the top, making this the strongest portion of the roof. It is an aspect of the current invention to transfer the forces acting on the shoes to the strongest portion of the roof. Although the present invention is discussed in terms of a system which includes an internal floating roof, the apparatus may be applied to external floating roofs as well.

It is important that the shoes be urged laterally against the wall surface of a tank. To that end the support mechanism for the shoes is preferably mounted on the upper surface of the floating roof. An exemplary apparatus of the current invention comprises spring loaded hanger-pushers attached to the top deck of the internal floating roof and to the ring of shoe segments. In another embodiment, the current invention contains a series of flat hair-pin springs in addition to the spring loaded hanger-pushers. Flat springs are particularly desirable for use in urging the shoes, because of their ability to transmit and absorb lateral forces. The hanger-pushers and hair-pin springs are arranged such that a natural tendency for level horizontal travel keeps the internal floating roof centered while keeping the shoe segments pressed against the tank wall. The hanger-pushers also support the shoe segments to keep them aligned vertically with each other and with the internal floating roof.

Jamming of the shoes due to flexure of the edge of the internal floating roof is greatly reduced due to the level horizontal movement. The hanger-pushers and hair-pin springs are located on the top of the internal floating roof deck, typically the strongest portion of that type of internal floating roof. Deck flexure relieves the vertical forces which cause jamming, rather than increasing them, since deck flexure causes the shoes to follow vertically behind the deck.

The overall depth of the sealing system can be held to approximately the height of the metal shoe itself, because the need for extensive diagonal bracing and stiffening of the outer portion of the internal floating roof is reduced or eliminated. This may result in increased useable capacity for a given tank.

Vertical movement of the lapped shoe segments with relation to each other is reduced due to the level horizontal movement of the hanger-pushers. This level horizontal movement also allows relatively simple flat springs to be securely attached to both the metal shoe and the rim of the internal floating roof avoiding any problems caused by twisting of the springs due to vertical movement of the shoes relative to the rim plate.

In one embodiment, the space between the ring of overlapped shoe segments and the edge of the internal floating roof is covered by an annular ring of flexible material, which acts as a vapor barrier, and is fastened near the top of the shoe segments and on the edge of the cover. An aspect of the current invention allows for the free movement of this flexible material across the overlapped expansion joint yet avoids the formation of gaps that would cause the sealing system to allow product losses in excess of those allowed for compliance with current regulations. The vapor barrier may be made of metal fabric or other suitable material or combination of materials. Fabric barriers are generally preferred.

It is an advantage of the apparatus disclosed herein that material costs and field labor costs may be decreased, both in the installation and maintenance of the rim sealing mechanism. Maintenance is decreased since there is no need to replace a fabric expansion joint or a cover for a metallic type expansion joint. Maintenance is also decreased since all of the critical operating parts are mounted above the flexible material vapor barrier, out of the vapors of the product being stored. Since the sealing system is protected by the outer roof of the fixed roof tank it resides in, this positioning of the critical operating parts will maximize the service life of this design.

It is a further advantage of the apparatus disclosed herein that damage to internal floating roofs and sealing mechanisms due to jamming, caused by changes in the magnitude of the rim space, may be reduced.

As regulatory requirements in this field change frequently, more and more tanks may require changes in the sealing mechanism employed. The apparatus allows for a continuous sealing ring substantially without local gaps, and provides expansion-contraction capability which allows the sealing ring to follow irregular contours of the tank wall. The current invention may be retrofitted to virtually every known internal floating roof design in use today without extensive rebuilding and/or reinforcement of the existing internal floating roof's rim structure.

DETAILED DESCRIPTION OF THE INVENTION

Figure 1:
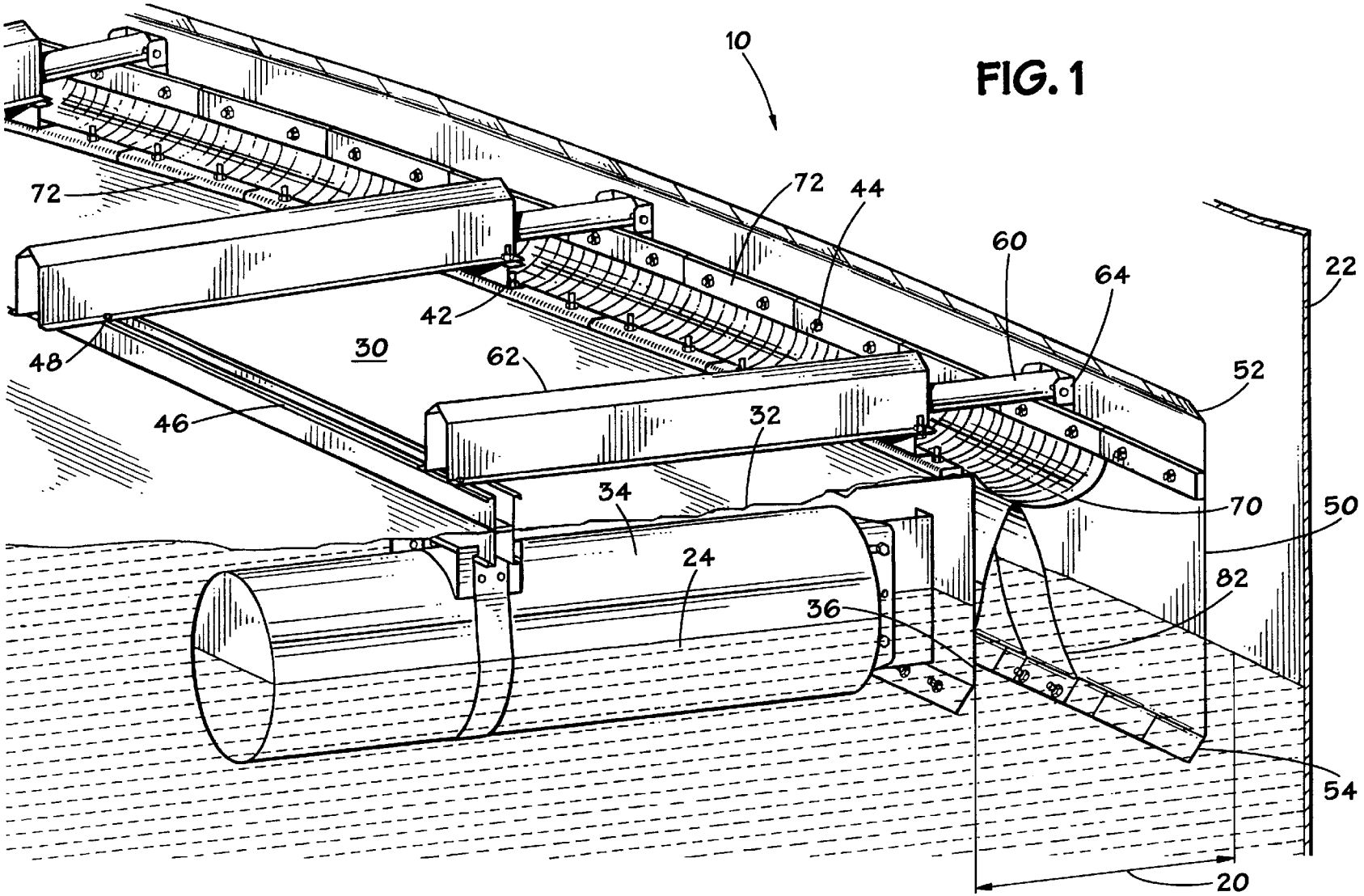
FIG. 1 is a three dimensional cut away side view with partial sectional view of a fixed roof storage tank with internal floating roof and sealing device in place.

Similar reference characters are used to indicate similar parts throughout the several views of the drawings. Referring to FIG. 1 of the drawings, one embodiment of the current invention is illustrated. As illustrated, apparatus 10 provides a seal of an interstitial rim space 20 between a tank wall 22, and an internal floating roof 30. The internal floating roof 30 typically has a top deck 32, an outer wall or peripheral rim 36, and flotation means 34, enclosing an airspace, or other means of buoyancy, such that the cover comprising the internal floating roof 30 stays afloat on the liquid contents of a storage tank.

Figure 3:
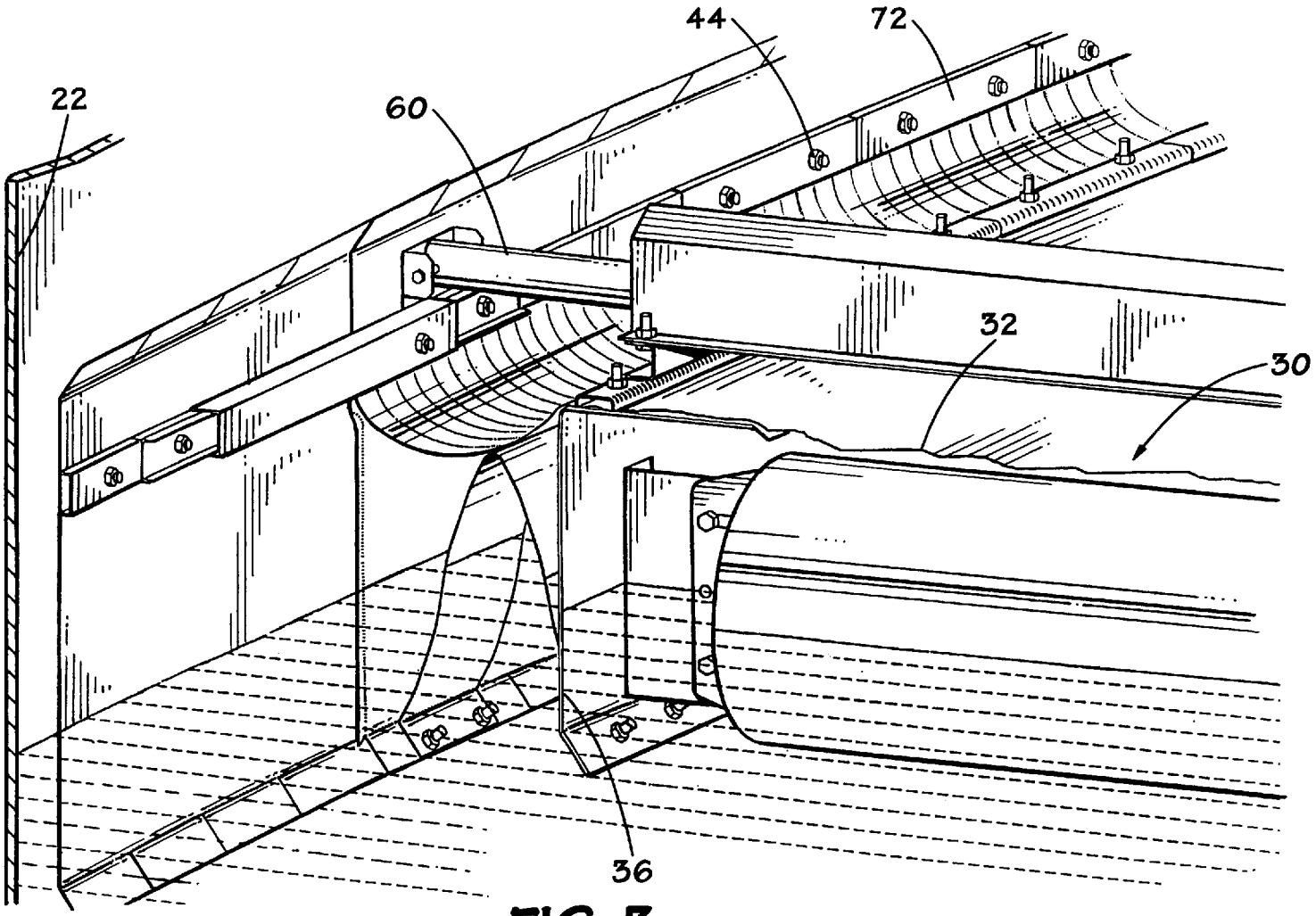
FIG. 3 is a three dimensional cut away side view with partial sectional view of the tank, internal floating roof and sealing device in place, with static shunt-spring and expansion joint retainer channel in place.
Figure 10:
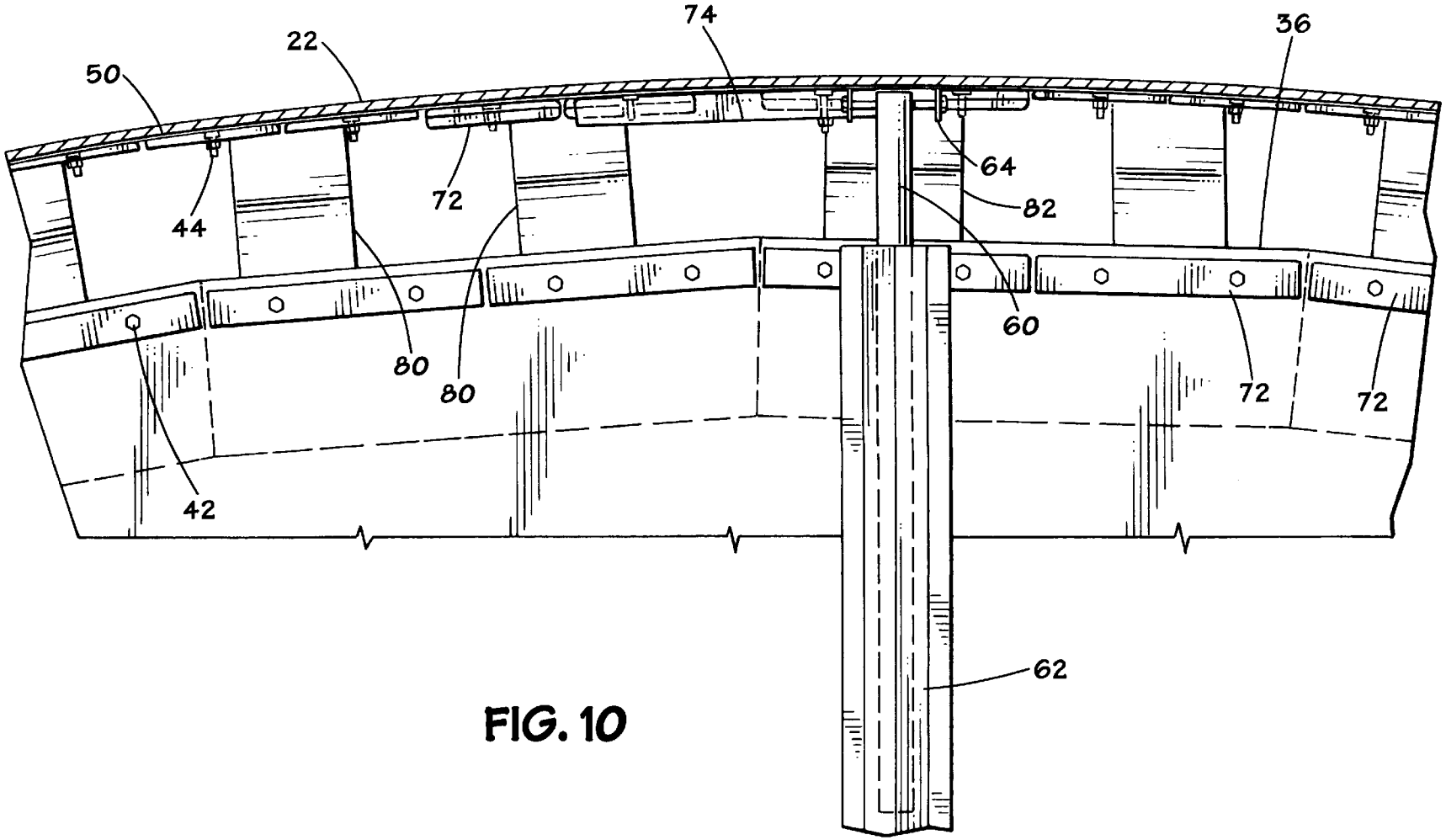
FIG. 10 is a top view (taken along the line 10—10 of FIG. 11) of the tank wall with overlapping shoe segments and expansion joint retainer channel shown.
Figure 11:
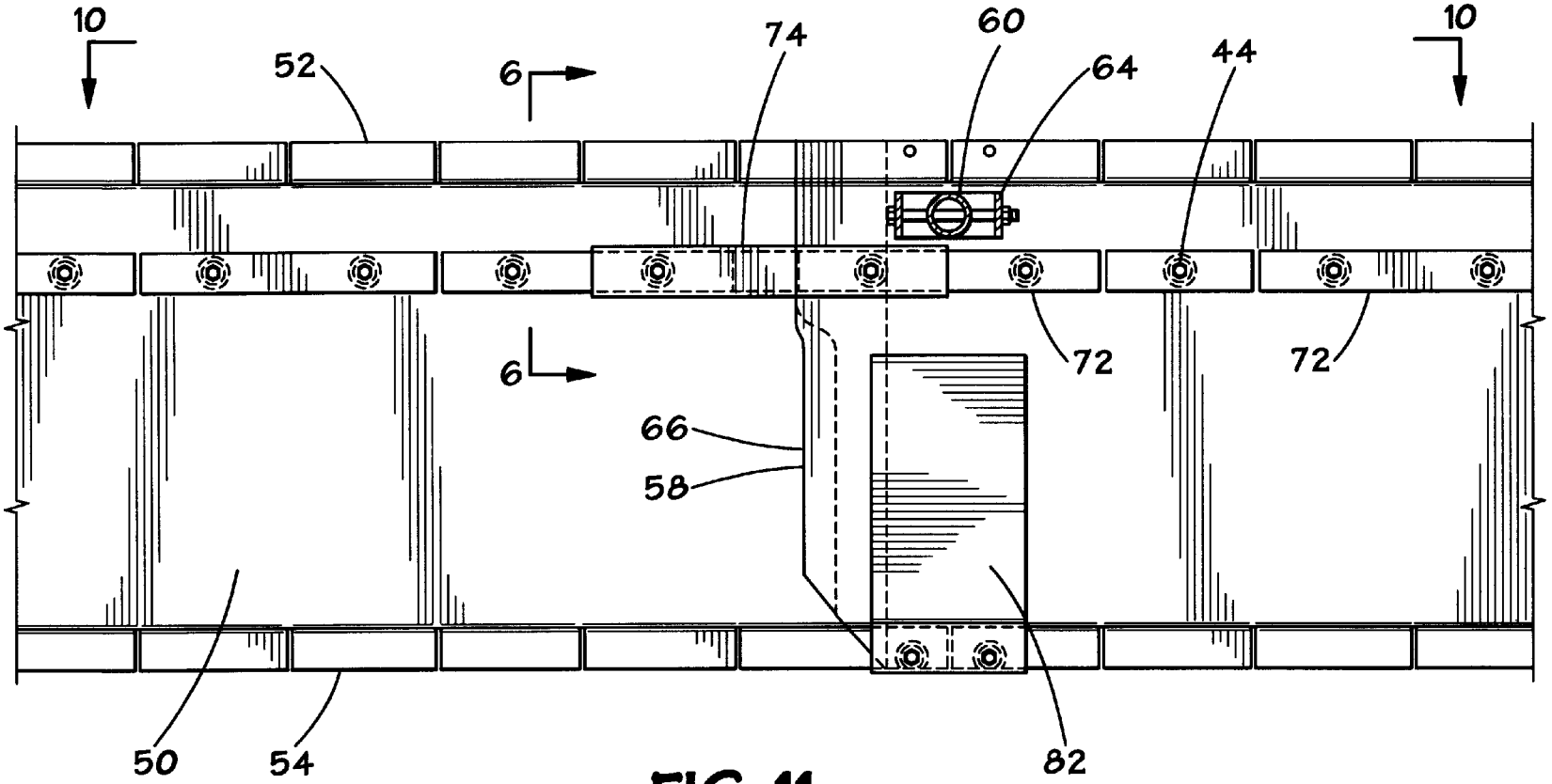
FIG. 11 is a frontal view of overlapping shoe segments showing areas of overlap, fastening channels with expansion joint retainer channel, stiffened leading edge, and shunt-spring.

A series of flexible shoe segments, or shoes, 50 are disposed around the periphery of the tank wall 22 and have front faces which are frictionally engaged with the wall. Shoes 50 may be made of metal or other suitable flexible material that is non-reactive with storage contents. In one embodiment, shoes 50 are made of stainless steel, and in another embodiment the shoes are made of galvanized sheet. The shoes 50 are lapped at side edges such that an edge of one shoe will overlap the edge of the adjacent shoe, as illustrated in FIGS. 3, 10 and 11. This ring of lapped shoes forms a continuous peripheral seal that completely encircles the inner circumference of the tank wall 22. In one embodiment the shoes are lapped at approximately 10 to 12 foot intervals, although larger or smaller shoe segments may be used, thereby creating more or less frequent lap intervals. By varying the size of the shoe segments, and/or the degree of overlap between the shoes, the sealing ring can easily be adapted to any tank configuration.

The top edge of each shoe 50 is bent inward toward the tank interior to create a top ramp edge 52, as is the bottom, creating a bottom ramp edge 54. These edges allow the sealing ring of shoe segments 50 to slide up and down the inner tank wall 22 without the edges catching on imperfections or irregularities in the contour of tank wall. In one embodiment, each shoe segment 50 is 10 to 12 feet long, 20 to 24 inches high, and has an overlap of about 6 inches. Those skilled in the art will recognize that these measurements may be varied and are not to be taken as restrictions.

The sealing ring of shoe segments 50 is normally biased outward by a series of expansive hanger-pushers 60. The expansive hanger-pushers 60 are resilient members, in that they can expand toward the tank wall 22, and can compress in a direction away from the tank wall. In one embodiment the hanger-pushers are spring loaded, although other embodiments are possible using hydraulic or pneumatic hanger-pushers. The expansive hanger-pushers 60 are attached to the upper surface of the internal floating roof 32. Generally, the upper surface of an internal floating roof contains the structural framing of the roof, making this the strongest portion.

It is desirable that the forces acting on the shoes be transferred to the strongest portion of the roof. Therefore, the expansive hanger-pushers may be alternately connected to the side of the internal floating roof such that the forces are transferred laterally into the upper framing of the internal floating roof. Other embodiments are envisioned where the expansive hanger-pushers may be connected to a bottom surface of the top framing of an internal floating roof (in an application where the internal floating roof is of low-profile design or does not contain side panels or skirts).

Figure 2:
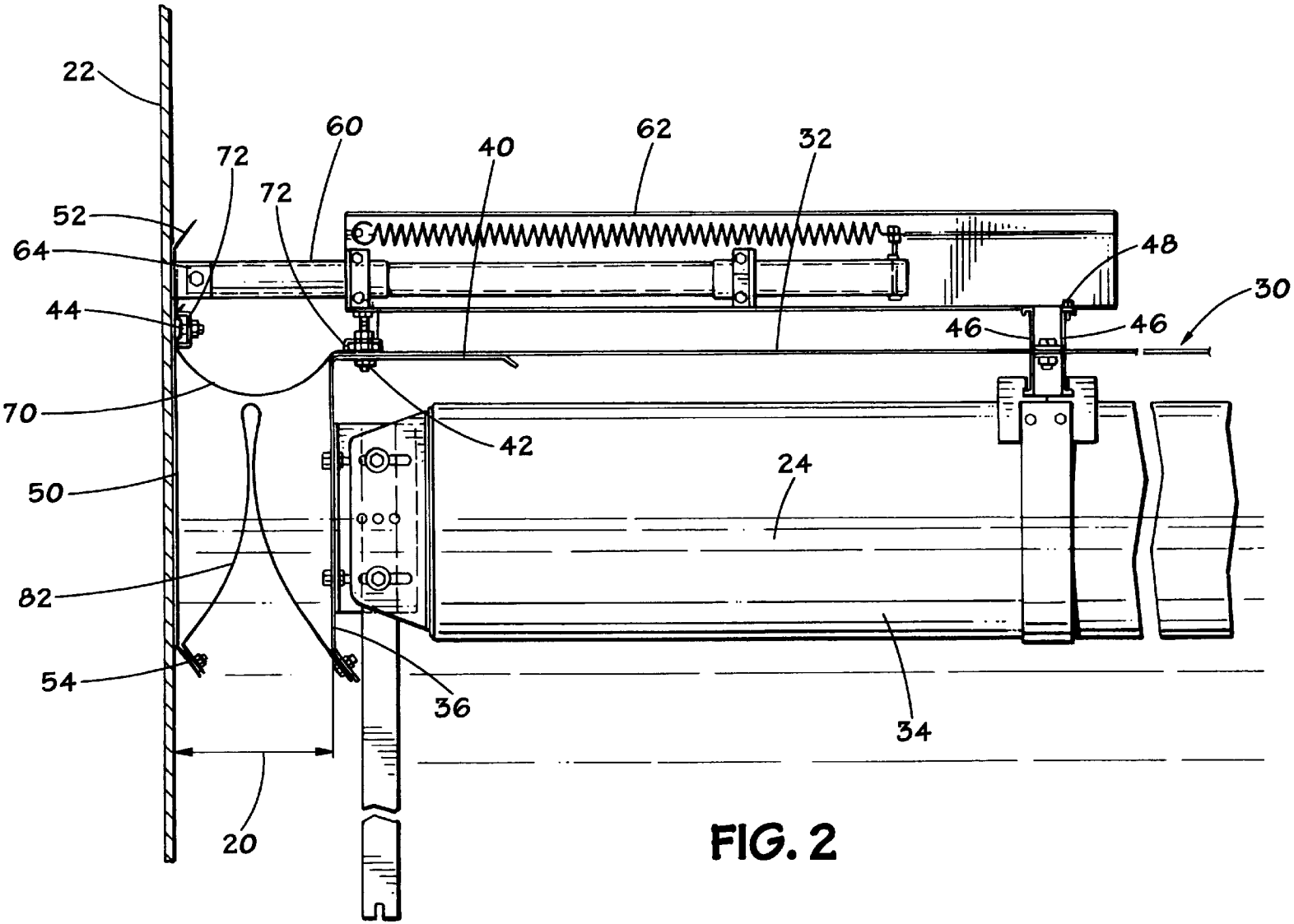
FIG. 2 is a cross-sectional view showing the internal floating roof, spring-loaded hanger-pusher, shoes, tank wall, flat spring-shunt, and fabric cover.
Figure 5:
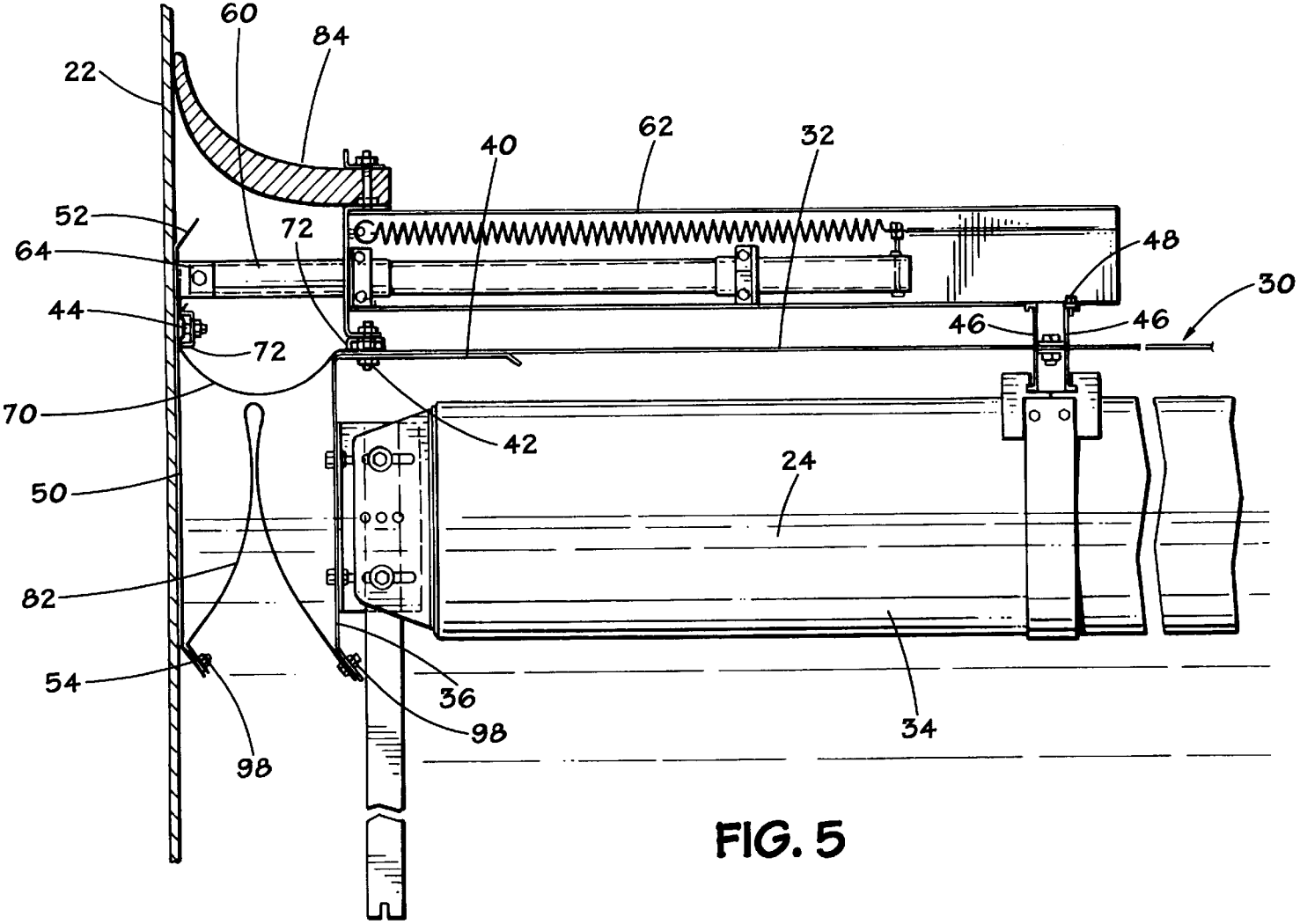
FIG. 5 is a side view similar to FIG. 4 but equipped with a wiper type secondary seal to further reduce vapor emissions.

Referring now to FIGS. 1, 2, and 5, the spring loaded hanger-pushers are attached at one end to the top surface 32 of the deck of the internal floating roof 30 by a hanger-pusher housing 62. A second end of the spring loaded hanger-pusher 60 is attached to a rear face of the shoe 50 by a shoe hanger bracket 64. An outer end of the hanger-pusher housing 62 is attached at or near the edge of the of the top surface 32 of the deck of the internal floating roof by bolts 42 or similar means. An inner end of the hanger-pusher housing 62 is attached to a structural member 46 on the top surface 32 of the deck of the internal floating roof, at some distance inboard from the edge, by bolts 48 or similar means. Simple cross members and/or housing extensions may be necessary to allow the inner end of the hanger-pusher housing to reach the nearest structural member for attachment.

As can be seen in FIG. 2, hanger-pushers 60 are adapted to force the shoes 50 outward from the internal floating roof 30 against the tank wall 22. As a result of this force, the roof is pushed in a direction away from the tank wall, thereby moving the floating roof to the center of the tank. The magnitude of the centering force will naturally tend to equalize with the force of the opposing hanger-pusher located on the opposite side of the internal floating roof. As a result, the hanger-pushers will tend to center the floating roof, regardless of irregularities in the tank diameter. In this way the hanger-pushers 60 act as centralizers for the internal floating roof 30.

In an alternate embodiment, the hanger-pushers may comprise a series of expansive linkage arms, whose pivot pins have vertical axes resulting in substantially horizontal movement. The expansive linkage arms may be disposed between the periphery of the floating roof and the shoe segments, and mounted to the upper portion of the internal floating roof's sidewall.

The force of the hanger-pushers 60, whether spring-loaded or otherwise adapted, is manifested by a sliding member as a substantially horizontal movement of the hanger-pushers into and out of the hanger-pusher housing 62. The sliding member may contain one or more linear bearings.

Because the hanger-pushers 60 are not pivotally connected to the shoes 50, but rather are connected and act in a manner that is substantially horizontal, vertical deflection of the internal floating roof does not result in an arc or increased angle between the hanger-pushers and the peripheral rim 36 of the internal floating roof 30. Vertical movement resulting from flexure of the deck is not transferred to the linkage between the shoe segments and the internal floating roof. Instead, when the deck flexes, the shoe segments 50 are dragged behind the deck by the hanger-pushers 60. As a result, deck flexure relieves the vertical forces which cause jamming, rather than increasing them.

Additional outward force on the shoes 50 may be exerted by flat shunt springs 82, which are connected between the shoes 50 and the peripheral rim 36 of the internal floating roof 30. As illustrated in FIG. 2, the shunt springs 82 are compressed, with one end attached to the bottom ramp edge 54 of the shoe 50, and the other end attached to the peripheral rim 36 of the internal floating roof 30. The shunt springs 82 also constitute a path allowing static electrical charges to drain from the internal floating roof 32 to the tank wall 22 which is grounded. This static electricity drain is important in tanks which store volatile and inflammable liquids, since vapors concentrate in the rim space between the floating roof and the tank wall. A spark resulting from an electrical discharge through the rim space could result in an explosion.

The lateral arrangement of spring loaded or otherwise expansive hanger-pushers 60 and shunt springs 82, as described above, keeps the sealing ring of shoes 50 in frictional contact with the tank wall 22. In addition, the substantially horizontal direction of the hanger-pushers 60 keeps the ring of shoes in vertical alignment with the internal floating roof 30.

Another benefit of this arrangement is that attachment of the hanger-pusher housing 62 to the top surface of the deck 32 transfers frictional and gravitational loadings from the sealing ring of shoe segments 50 to the upper portion of the internal floating roof 30, the strongest portion of that structure.

Figure 4:
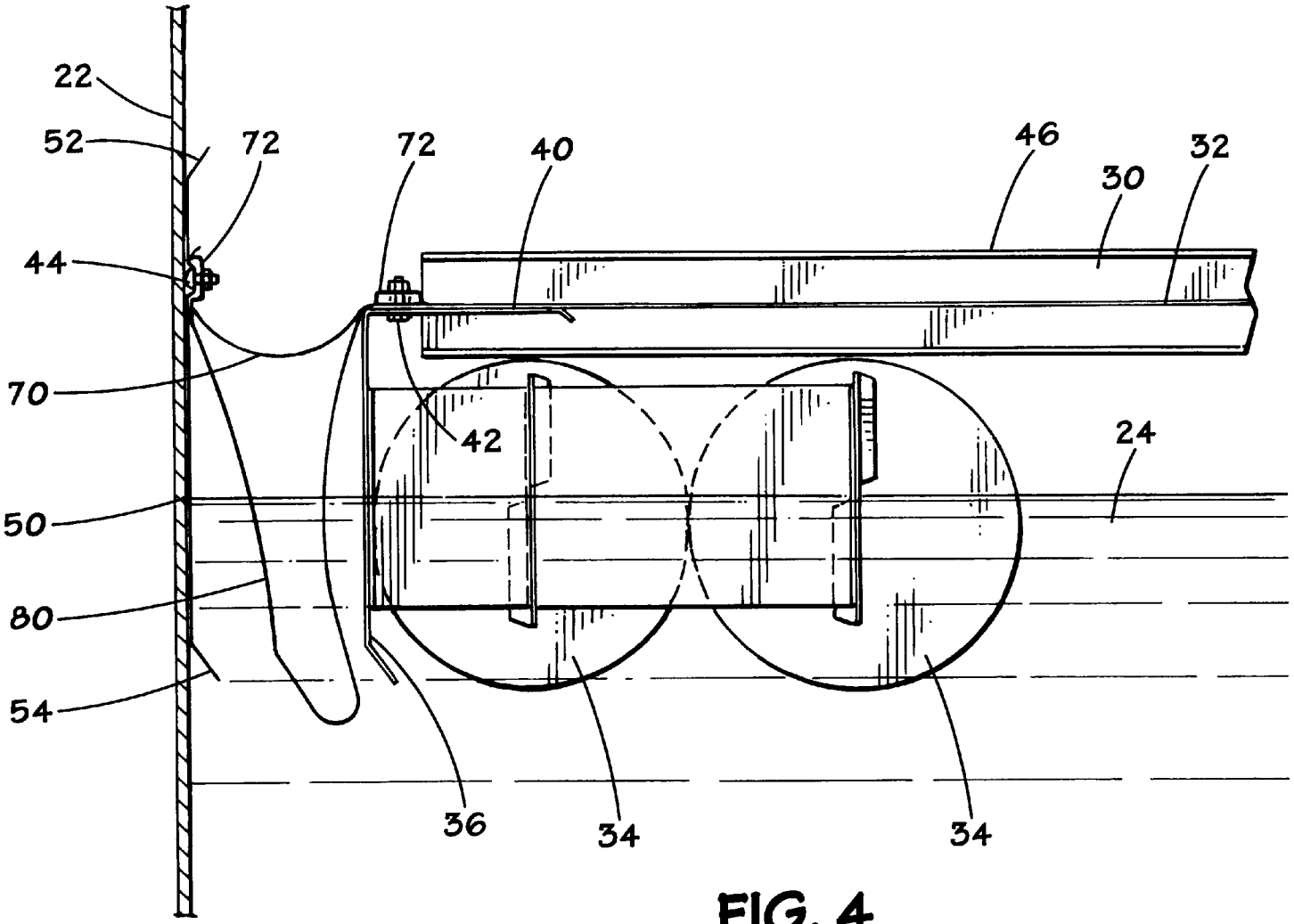
FIG. 4 is a side view of the flat hair-pin spring pusher at a location between the hanger-pushers.

Referring to FIG. 4, outward pressure on the sealing ring of shoe segments 50 may be maintained by a series of flat hair-pin pusher springs 80 which extend horizontally between the top of the peripheral rim 36 of the internal floating roof 30 and the shoe segments 50. Flat springs are particularly desirable because of their ability to transmit and absorb lateral forces.

Hair-pin pusher springs 80 may be used in conjunction with the hanger-pushers described above. In one embodiment, the flat hair-pin pusher springs 80 are distributed between the hanger-pushers. The attachment of the flat hair-pin pusher spring 80 to the shoe 50 may be accomplished by passing a first end of the flat hair-pin pusher spring under a fabric clamp channel 72 which is coupled to the shoe 50, or by connecting to a separate bolt or other fastening means attached to the shoe segment 50. A second end of the spring 80 can be fastened to the top of the peripheral rim 36 of the internal floating roof 30 by passing under the fabric clamp channel 72 which is coupled to the internal floating roof, or by connecting to a separate fastener or other fastening means.

As can be seen in FIGS. 10 and 11 the shoes 50 overlap. At one side edge of each shoe segment 50, a reinforcement 58 is formed into, or otherwise attached to, the shoe so as to create a stiffened area. The stiffened area is that portion of the shoe extending substantially between the bracket 64 connecting a hanger-pusher 60 to the upper portion of a shoe segment 50 and the shunt-spring 82 connected to a bottom portion of the shoe segment. This stiffened area defines an zone of overlap between two adjacent shoe segments 50, allowing for expansion and contraction of the sealing ring to accommodate fluctuations or irregularities in the circumference of the tank. In one embodiment, a six inch overlap is anticipated. Locating the hanger-pusher 60 and shunt-spring 82 at the top and bottom of this stiffened leading edge provides pressure on the underlying shoe 50 forcing the two overlapping shoe segments 56 together and forming a no-gap flexible joint.

Referring now to FIGS. 1, 2, and 3, the interstitial space 20 between the sealing ring of shoe segments 50 and the peripheral rim 36 of the internal floating roof 30 is sealed by flexible material 70 which acts as a vapor barrier to prevent loss of the stored fluid in excess of those allowed for compliance with current regulations. The flexible material also helps to seal off the shoes and the upper surface of the floating roof from the contents of the tank.

Flexible material 70 may be metal, fabric, plastic, or other suitable material. One boundary of the flexible material 70 is fastened near the top ramped edge 52 of the shoes 50 by a series of fastening channels 72. An outer edge of the flexible material 70 is passed under an end of the fastening channels 72. The fastening channels 72 are attached to the shoes 50 by bolts 44, screws, or other suitable fastening means, and may be tightened against the shoes 50 in order to securely clamp the flexible material 70 to the shoes 50. At a second boundary, an inner edge of the flexible material 70 is connected to a rim plate 40 on the upper edge of the peripheral rim 36 of the internal floating roof 30. An edge of the flexible material 70 is passed under an end of a second series of fastening channels 72, which are connected to the rim plate 40. As above, the fastening channels 72 are attached to the rim plate 40 by bolts 44, screws, or other suitable fastening means, and may be tightened against the rim plate 40 in order to securely clamp the flexible material.

Although not shown, strips of flexible material 70 may be used to form the seal member. The strips may be fastened together by any suitable means such as adhesive, clips, and the like. Fastening the strips of flexible material essentially retains the integrity of the vapor barrier, since it may not be practical to install very large unbroken sections of a flexible material.

Referring to FIG. 5, additional protection against loss of the fluid as a vapor may be accomplished by adding a secondary sealing device 84. The secondary sealing device may be a wiper-type seal, or other sealing device, and may be attached at one end to the peripheral rim 36 of the internal floating roof 30.

Figure 6:
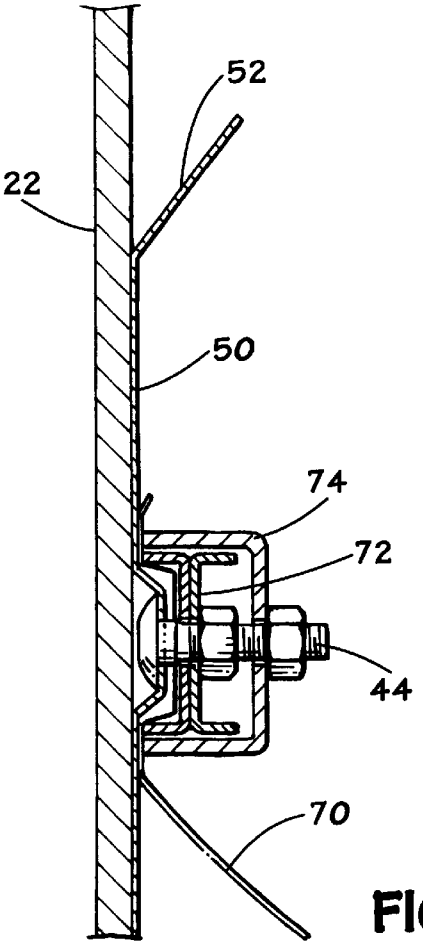
FIG. 6 is a detailed cross-sectional side view (taken along the line 6—6 of FIG. 11) showing the tank wall with shoe and attached upper fastening channel, and illustrating the counter-sunk configuration of the shoe and the placement of the expansion joint retainer channel.
Figure 9:
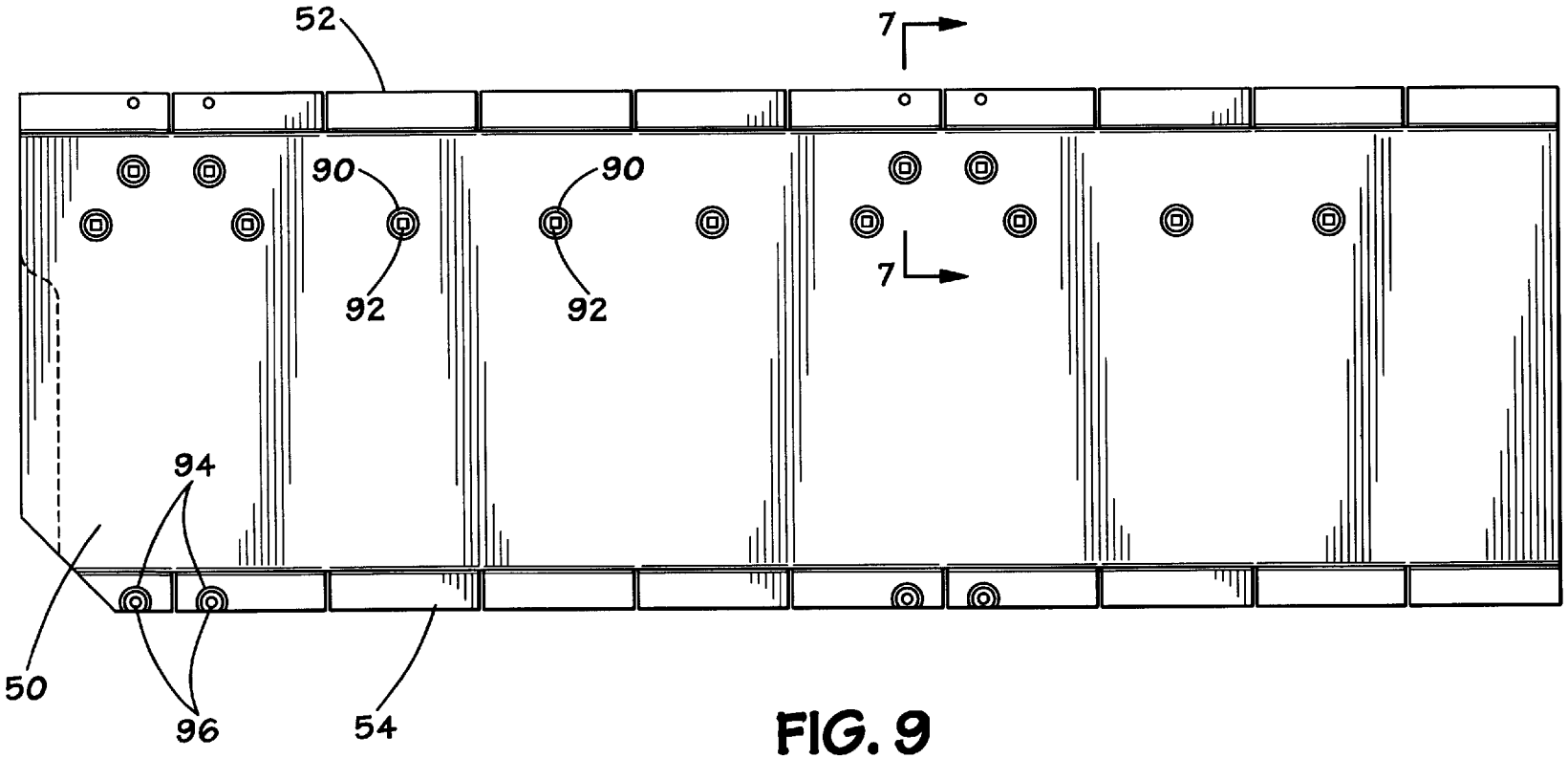
FIG. 9 is a frontal view of one of the shoe segments with all countersunk areas shown.

Vertical frictional forces occur in the shoe segments 50 as a result of movement up and down the tank wall 22. The movement occurs as the internal floating roof 30 flexes or is displaced by changes in liquid level. Referring now to FIG. 6, these vertical frictional forces between the shoe segments 50 are transferred between shoe segments by an expansion joint retainer 74. In the areas of shoe segment 50 overlap, the expansion joint retainers 74 are coupled across the overlapped area, or expansion joint, on the inner surface of the shoes 50. In one embodiment, the expansion joint retainer 74 is a channel, and one possible means of holding this channel is illustrated in FIG. 6.

As discussed above, a fastening channel 72 is connected to the shoe segments 50 to flexibly attach one end of the flexible material 70. At the area of shoe segment overlap a second fastening channel 72 is installed. The first and second fastening channels mounted in a back-to-back arrangement with the legs of the channels substantially aligned. The legs of the first fastening channel depend toward shoe segment 50, and the legs of the second fastening channel depend toward the internal floating roof 30. The expansion joint retainer 74 is positioned to straddle the surface of the fastening channels' legs, and is attached at both sides of the expansion joint area to the shoes 50.

The expansion joint retainer 74 may be a channel or other suitable shape formed of aluminum, stainless steel, or other suitable material, and should be of sufficient size to fit snugly outside the back-to-back fastening channel 72, while allowing horizontal movement when the overlap between the shoe segments 50 expands or contracts.

In the embodiment illustrated in FIG. 6, the channel-shaped expansion joint retainer 74 is attached to the inboard leading edge of the overlapped shoe using the same fastener (s) as the back-to-back fastening channels 72. Each overlap area has one channel-shaped expansion joint retainer 74 which extends the length of the overlap area and an additional length for retention on the back-to-back fastening channels 72 on each side of the overlap. In one embodiment the channel-shaped expansion joint retainer 74 extends from the center of the back-to-back fastening channels 72, across the overlap between shoe segments 50, and beyond the center of the adjacent shoe segments on both sides. Similar channel-shaped expansion joint retainers 74 would be installed at each overlap.

In addition to transferring vertical forces between the shoes 50, channel 74 also help to keep flexible material 70 pressed against shoe 50. When there is contraction of the ring of shoes 50, causing greater overlap of the shoes, the flexible material 70 may tend to buckle, or "pucker." The expansion joint retainer channel 74 helps to correct this.

Figure 8:
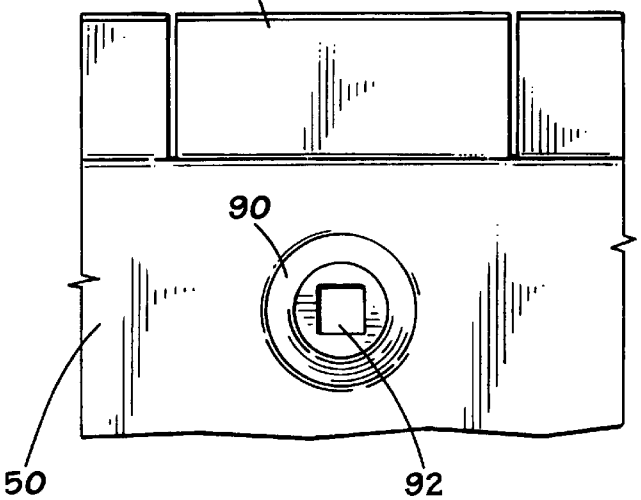
FIG. 8 is a frontal view (taken along the line of 8—8 of FIG. 7) of a countersunk area in the shoe segment.
Figure 7:
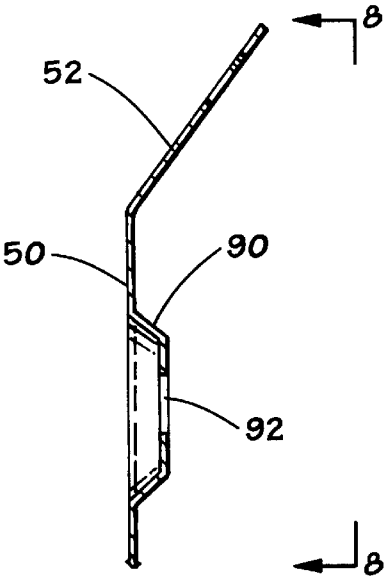
FIG. 7 is a cross-sectional side view (taken along the line 7—7 of FIG. 9) of a countersunk area in the shoe segment.

FIGS. 6–9 illustrate in more detail methods of attaching the components of the current invention. Shoe segments 50 have countersunk areas 90 and holes 92 for fastening channel bolts 44. By countersinking the bolt heads, fastening channel 74 can be through-bolted to a shoe segment 50, without creating resistance as the shoe segment slides along the tank wall 22. A second array of countersunk areas 90 and holes 92 may be present for attaching the shoe bracket 64 of the spring-loaded or other hanger-pushers 60. One embodiment would attach the shoe bracket 64 with the same series of countersunk areas 90 and holes 92 used for the upper fastening channel 72 bolts 44. Another series of countersunk areas 94 and holes 96 is present for attaching the ends of the shunt-springs 82 by bolts 98. FIG. 7 illustrates a cross-sectional side view of the countersunk area 94 and hole 96 for the fastening channel 72. FIG. 8 illustrates the same area in a frontal view. The countersunk areas 90 and 94 and holes 92 and 96 provide a smooth surface on the reverse of the shoe segments 50 so there is no interference with the sliding of the shoes 50 on the tank wall 22.

Figure 12:
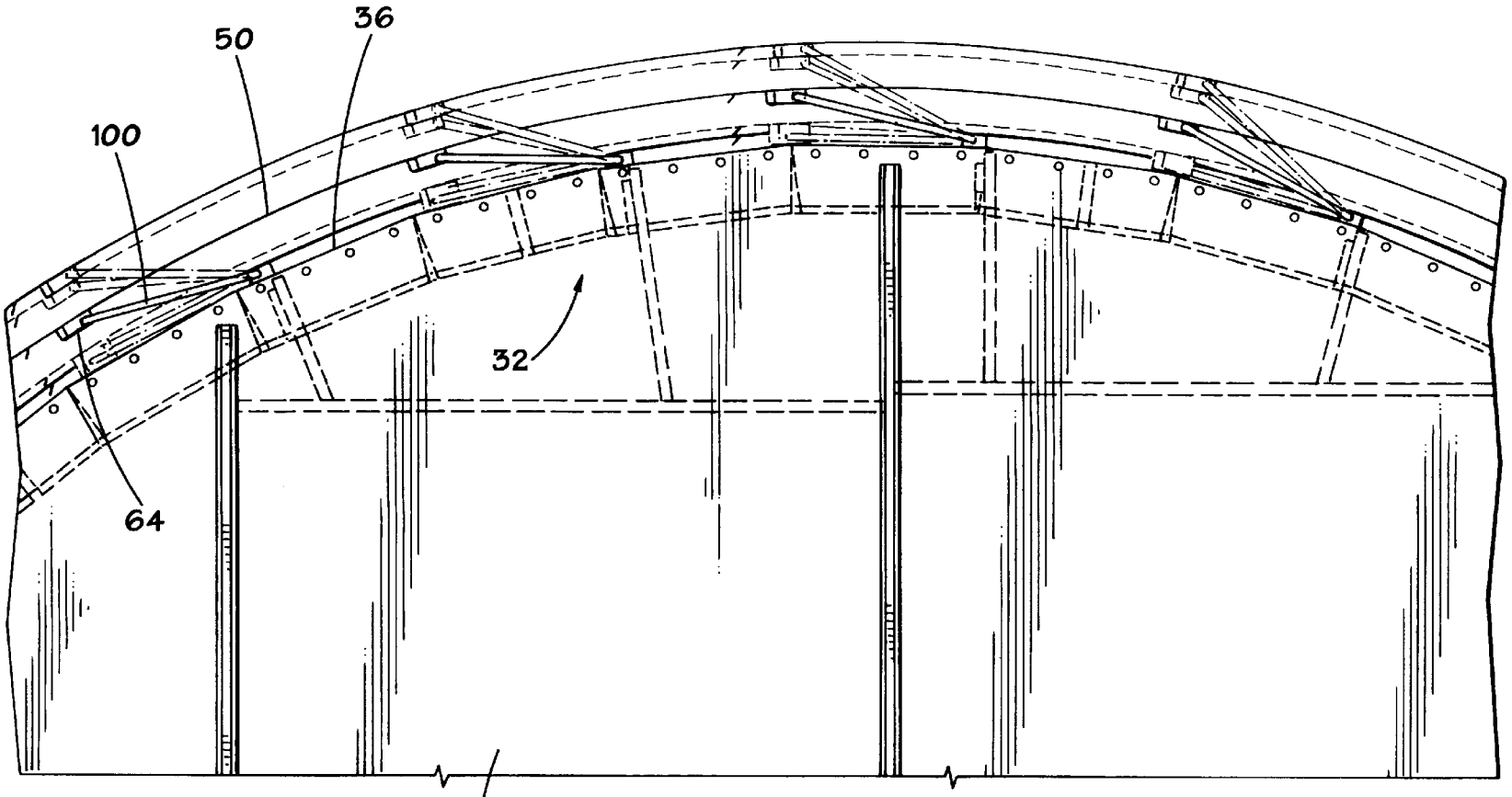
FIG. 12 is a top view of the internal floating roof and swing-arm-shoe supports.

In still another embodiment as shown in FIG. 12, the apparatus of the current invention contains a series of swing-arms 100 that support the vertical load of the shoes 50 and maintain the shoes in vertical alignment with the floating roof 30. In this embodiment, the swing-arms 100 travel in a lateral arc outward from or toward roof 30, roughly parallel to the plane of top deck 32, as the interstitial rim space 20 varies. Shoe brackets 64 contain slots 65, at which the swing-arms 100 are slidably connected to the brackets. The swing-arms 100 are preferably of sufficient length that the arc of travel is small, and slots 65 can transfer the motion away from or toward the peripheral rim 36 of roof 30, without causing the shoes 50 to move in a circumferential direction around the tank wall 22.

Figure 13:
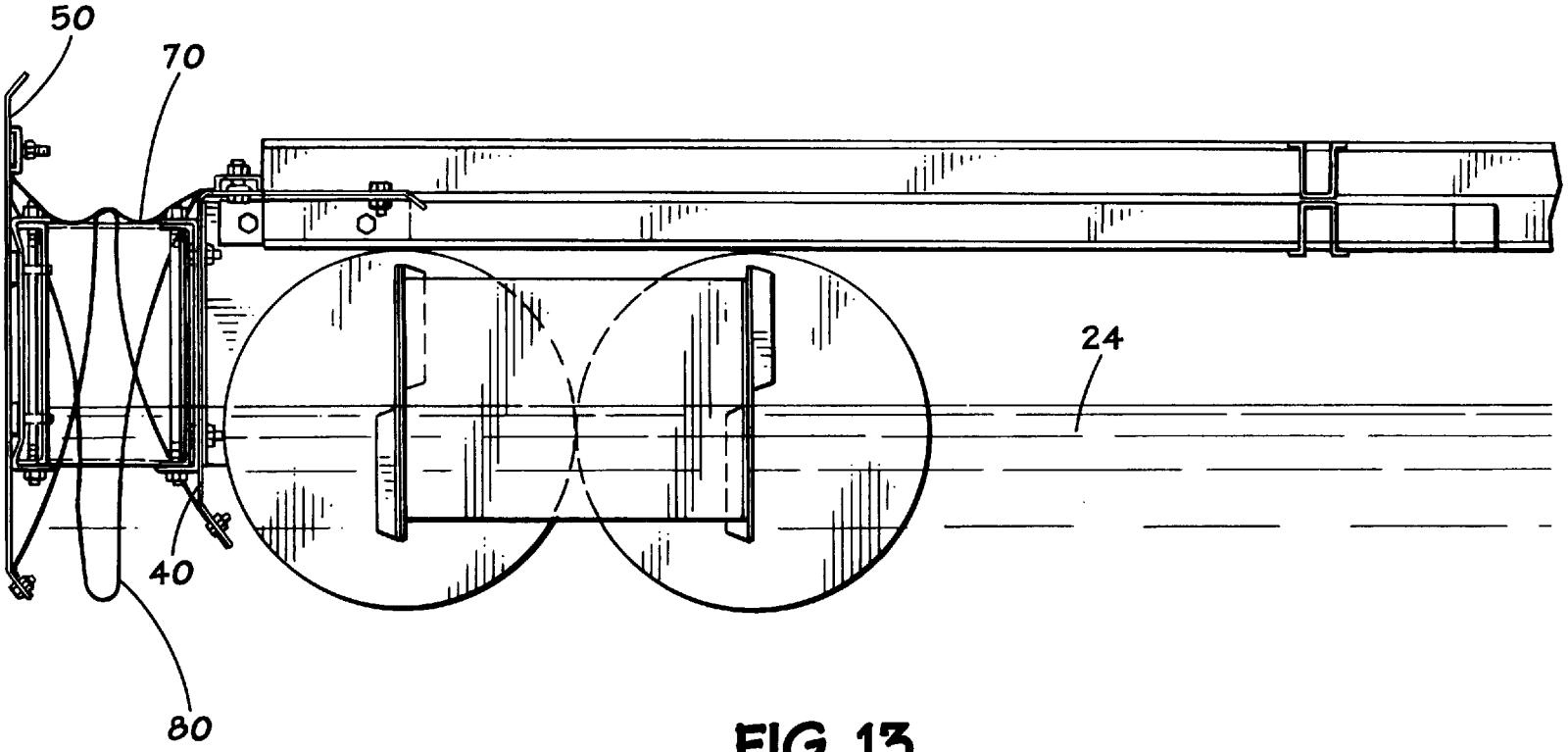
FIG. 13 is a cross-sectional side view of the floating roof, swing-arm, shoes, and tank wall.
Figure 14:
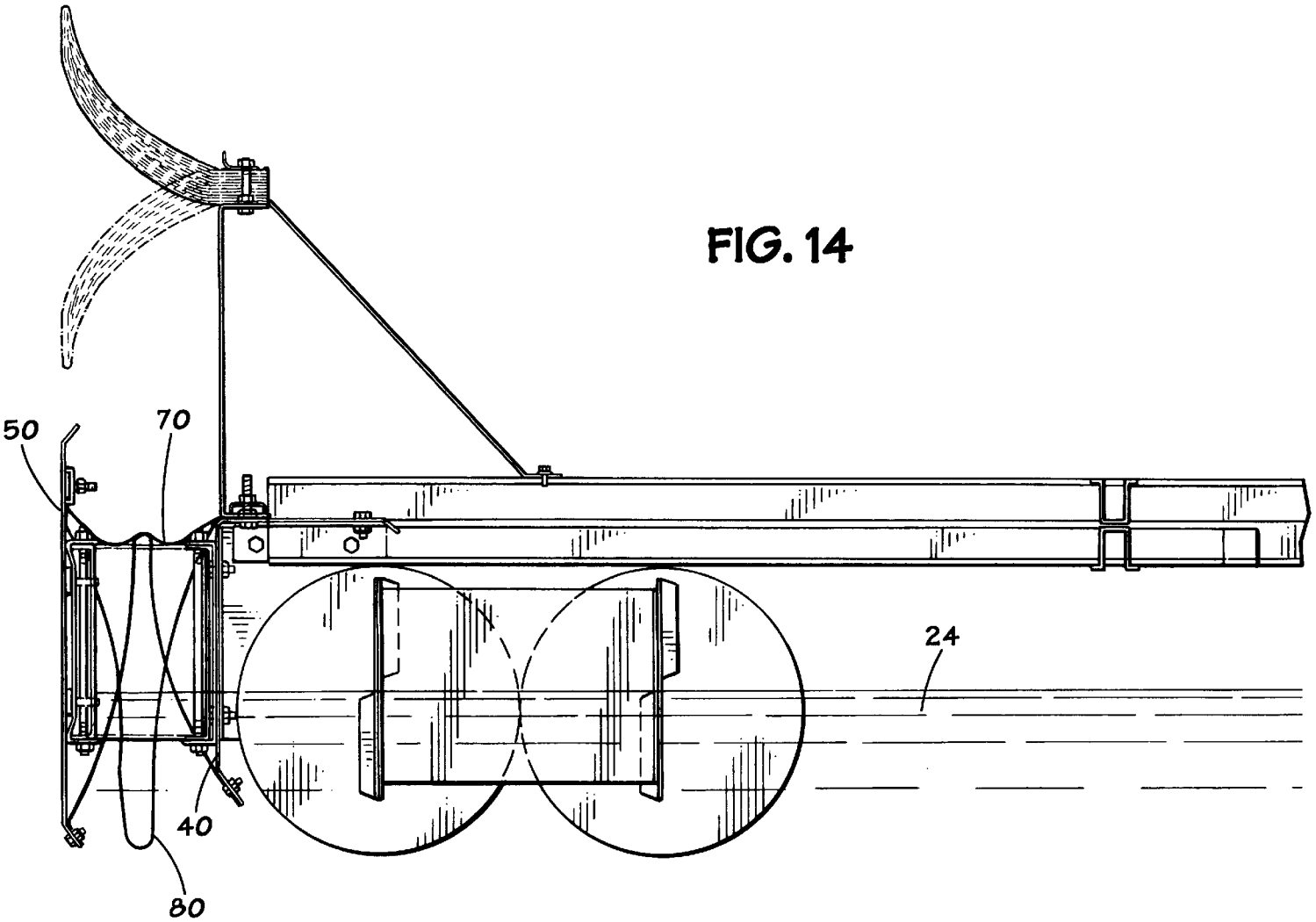
FIG. 14, is a side view similar to FIG. 13, also including a wiper type secondary seal.

As shown in FIGS. 13 and 14, the shoes 50 are urged laterally toward the tank wall 22 by flat hair-pin pusher springs 80, which may be attached in the manner discussed above. FIG. 14 shows the system of FIGS. 12 and 13, but with the addition of a secondary sealing device 84. In the embodiment shown in FIGS. 12–14, the flat hair-pin springs 80 are the sole source of outward pressure on shoes 50, while the swing-arms 100 provide vertical support for the shoes 50. Other embodiments are envisioned wherein biasing members known in the art, including, for example, coiled springs, shunt springs, or compressed elastomeric members, are employed to provide bias away from the floating roof on shoes 50. In another alternative embodiment swing-arm 100 may provide outward bias through hinge springs or other biasing members acting directly on the swing-arms.

The above description and several embodiments of the present invention are made by way of example and not for purposes of limitation. While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the following claims, including the full range of equivalency to which each element thereof is entitled.

What is claimed is:

1. A floating roof in combination with an apparatus for sealing an interstitial space between an inner wall of a storage tank and said internal floating roof when said roof is movably disposed within the storage tank, comprising:

a plurality of shoes each having a front face and a rear face, disposed between said inner wall of the storage tank and a periphery of said internal floating roof;

a plurality of resilient members, the resilient members comprising unpivoted horizontally slidable supports coupled to an upper surface of the periphery of said internal floating roof and said rear face of each of said shoes, said supports being adapted to support said shoes and to transfer forces acting on said plurality of shoes to said internal floating roof in a substantially lateral direction, and a plurality of biasing members coupled to the supports to bias said front faces of each of said shoes in slidable contact against said inner wall of the storage tank in a substantially horizontal direction, and;

a flexible sealing member attached along a first boundary to said shoes and along a second boundary to said internal floating roof.

2. The apparatus of claim 1, further comprising a plurality of shunt-springs, each of said shunt-springs having a first end connected to said periphery of the internal floating roof and a second end connected to a said rear face of said shoes.

3. The apparatus of claim 1, further comprising a plurality of flat springs, each of said flat springs connected to said periphery of the internal floating roof and to a said rear face of said shoes, being adapted for laterally urging said shoes to resiliently contact said inner wall of the storage tank.

4. The apparatus of claim 1, wherein each of said shoes has a side edge overlapping an adjacent shoe.

5. The apparatus of claim 4, further comprising a plurality of expansion joint retainers extending between the side edge of a first shoe and an adjacent shoe, and being connected to said first shoe and to said adjacent shoe.

6. The apparatus of claim 5, wherein said side edge of said first shoe is reinforced.

7. The apparatus of claim 1, further comprising a secondary seal member having a first end connected to said internal floating roof and a second end disposed against said inner wall of the storage tank.

8. The apparatus of claim 1, wherein said seal member comprises a flexible material.

9. The apparatus of claim 8, further comprising a plurality of channels connected to said rear faces of said shoe segments, capable of clamping said flexible material between said channels and said rear faces of said shoe segments.

10. The apparatus of claim 8, wherein said flexible material comprises a fabric.

11. The apparatus of claim 1, wherein said plurality of s hoes are formed of galvanized sheet metal.

12. The apparatus of claim 1, wherein said plurality of shoes are formed of stainless steel sheet metal.

13. A floating roof in combination with an apparatus for sealing a space between said floating roof, when disposed within a tank, and an inner wall of the tank, comprising:

a sealing ring formed of a plurality of shoes;

a plurality of expansive members laterally disposed between said shoes and the periphery of said floating roof, said expansive members coupled to an upper surface of the periphery of said floating roof, and being adapted to support said shoes and to bias said shoes against said inner wall of the tank in a substantially horizontal direction, and to transfer forces acting on said plurality of shoes to said internal floating roof in a lateral direction such that deflection of the internal floating roof does not result in a substantially increased angle between the expansive members and the periphery of said internal floating roof; and a flexible seal member coupled along a first boundary to said shoes and along a second boundary to said floating roof.

14. The apparatus of claim 13, further comprising at least one linear bearing, operatively connected to said expansive members, slidable in a substantially horizontal direction.

15. The apparatus of claim 13, wherein said expansive members comprise a plurality of linkage arms having vertical pivot pins, and said linkage arms are movable in a substantially horizontal direction.

16. A floating roof in combination with an apparatus for sealing a space between an inner wall of a storage tank and said floating roof when said roof is disposed within the storage tank, comprising:

a sealing ring formed of a plurality of shoes;

a plurality of shoe hanger brackets coupled to the plurality of shoes;

a plurality of swing-arms having first and second ends, the swing-arms rotatably attached at said first ends to said floating roof and vertically pivoted to rotate laterally in a substantially horizontal direction from said floating roof, and coupled at said second ends to said shoe hanger brackets, whereby said swing-arms support said shoes;

a plurality of biasing members mounted between said shoes and said floating roof to bias said shoes toward said inner wall, and;

a flexible seal coupled along a first boundary to said shoes and along a second boundary to said floating roof.

17. The apparatus of claim 16, further comprising a secondary seal member having a first end connected to said internal floating roof and a second end disposed against said inner wall of the storage tank.

18. The apparatus of claim 16, wherein said biasing members comprise a plurality of shunt-springs, each of said shunt-springs having a first end connected to said floating roof and a second end connected to one of said shoes.

19. The apparatus of claim 18, further comprising a plurality of flat springs, each of said flat springs connected to said floating roof and to at least one of said shoes, being adapted for laterally urging said shoes to resiliently contact said inner wall of the storage tank.

20. The apparatus of claim 16, wherein each of said shoes has a side edge overlapping an adjacent shoe.

21. The apparatus of claim 20, further comprising a plurality of expansion joint retainers extending between the side edge of a first shoe and an adjacent shoe, and being connected to said first shoe and to said adjacent shoe.

22. The apparatus of claim 16, further comprising a plurality of channels connected to said shoes, capable of clamping said flexible seal between said channels and said shoes.

23. The apparatus of claim 16, wherein said plurality of shoes are formed of galvanized sheet metal.

24. The apparatus of claim 16, wherein said plurality of shoes are formed of stainless steel sheet metal.

25. A floating roof in combination with an apparatus for sealing an interstitial space between an inner wall of a storage tank and said internal floating roof when said roof is movably disposed within the storage tank, comprising:

a plurality of shoes each having a front face and a rear face, disposed between said inner wall of the storage tank and the periphery of said internal floating roof;

a plurality of resilient members, the resilient members comprising supports pivoted about a vertical axis and coupled at a first end to said internal floating roof and at a second end to a said rear face of each of said shoes, said supports being adapted to support said shoes and to transfer forces acting on said plurality of shoes to said internal floating roof in a lateral direction, and a plurality of biasing members coupled to the supports to bias said front faces of each of said shoes in slidable contact against said inner wall of the storage tank in a substantially horizontal direction, and;

a flexible sealing member attached along a first boundary to said shoes and along a second boundary to said internal floating roof.

26. The apparatus of claim 25, wherein said resilient members are coupled to an upper surface of said internal floating roof.

27. The apparatus of claim 25, further comprising a plurality of shunt-springs, each of said shunt-springs having a first end connected to said periphery of the internal floating roof and a second end connected to the rear face of one of said shoes.

28. The apparatus or claim 25, further comprising a plurality of flat springs, each of said flat springs connected to said periphery of the internal floating roof and to the rear face of one of said shoes, being adapted for laterally urging said shoes to resiliently contact said inner wall of the storage tank.

29. The apparatus of claim 25, wherein each of said shoes has a side edge overlapping an adjacent shoe.

30. The apparatus of claim 29, farther comprising a plurality of expansion joint retainers extending between the side edge of a first shoe and an adjacent shoe, and being connected to said first shoe and to said adjacent shoe.

31. The apparatus of claim 30, wherein said side edge of said first shoe is reinforced.

32. The apparatus of claim 25, further comprising a secondary seal member having a first end connected to said internal floating roof and a second end disposed against said inner wall of the storage tank.

33. The apparatus of claim 25, wherein said seal member comprises a flexible material.

34. The apparatus of claim 33, further comprising a plurality of channels connected to said rear faces of said shoe segments, capable of clamping said flexible material between said channels and said rear faces of said shoe segments.

35. The apparatus of claim 33, wherein said flexible material comprises a fabric.

36. The apparatus of claim 25, wherein said plurality of shoes are formed of galvanized sheet metal.

37. The apparatus of claim 25, wherein said plurality of shoes are formed of stainless steel sheet metal.

* * * * *